United States Patent [19]

Vancil

[11] Patent Number: 4,954,745

[45] Date of Patent: Sep. 4, 1990

[54] CATHODE STRUCTURE

[75] Inventor: Bernard K. Vancil, Beaverton, Oreg.

[73] Assignee: Tektronix, Inc., Beaverton, Oreg.

[21] Appl. No.: 327,074

[22] Filed: Mar. 22, 1989

[51] Int. Cl.[5] ..... H01J 29/48; H01J 1/15

[52] U.S. Cl. ..... 313/446; 313/270; 313/338

[58] Field of Search ..... 313/446, 270, 337, 340, 313/38, 457, 456

[56] References Cited

U.S. PATENT DOCUMENTS 2,859,371 11/1958 Watson et al. ..... 313/270 X
3,967,150 6/1976 Lien et al. ..... 313/338

FOREIGN PATENT DOCUMENTS 2503448 8/1975 Fed. Rep. of Germany ..... 313/446

OTHER PUBLICATIONS

"A Cavity Reservoir Dispenser Cathode for CRT's and Low-Cost Traveling-Wave Tube Applications", Louis R. Falce, *I.E.E.E. Transaction on Elctron Devices*, vol. 36, No. 1, Jan. 1989.

*Primary Examiner*—Sandra L. O'Shea
*Attorney, Agent, or Firm*—John D. Winkelman; John P. Dellett

[57] ABSTRACT

A dispenser cathode body includes a heat capturing portion extending rearwardly from the dispenser cathode, said heat capturing portion having greater mass and thickness than an exterior support skirt. A slip-in heater is received within the heat capturing portion. Substantially greater electron emission density is secured without requiring injuriously high temperatures from the slip-in heater.

16 Claims, 3 Drawing Sheets

CATHODE STRUCTURE

BACKGROUND OF THE INVENTION

The present invention relates to a cathode structure for cathode-ray-tubes and particularly to such a structure for providing high current density emission.

The performance of cathode-ray-tubes is often limited by the current density of the electron beam. In the case of the typical measurement CRT used in oscilloscopes, cathode emission limits the ability of the instrument to utilize the bandpass available. Although an electron beam can be deflected rapidly enough for viewing very "fast" events, the lack of beam current may render the resulting trace so dim that it cannot be seen. In display CRTs such as used for computer terminals, work stations and the like, the information density and resolution are limited since spot size on the CRT screen is governed by electron beam current density.

Simply running a conventional CRT cathode at a higher temperature, in order to permit increased cathode loading, drastically reduces the life span of the cathode. A higher beam current can be obtained with a "dispenser" cathode, e.g. comprising a sintered material such as tungsten impregnated with an electron emissive material. However, construction of these cathodes presents various problems. A dispenser cathode with a potted heater might produce enough heat, but such a structure is difficult and expensive to manufacture in small sizes for a CRT. When utilizing a "slip-in" or insertable heater, the structures heretofore proposed have been unable to cope with heater burn-out problems inasmuch as the heater must be operated at an excessively high temperature in order to heat the cathode to the necessary level. Prior art structures have employed reentrant tubular metal structures having electron dispensers disposed at the end of a thin metal tube within which the heater element is located. Unfortunately, much of the heat provided is radiated or conducted away down the metal support tube rather than being effective in raising the temperature of the cathode emitter. Moreover, the prior structures have been mechanically unstable resulting in unpredictable electronic properties.

SUMMARY OF THE INVENTION

In accordance with the present invention in a preferred embodiment thereof, a cathode structure includes a cathode body having an electron emissive portion comprised of sintered metal material impregnated with a substance for emitting electrons at elevated temperatures, and a heat capturing portion conductively joined thereto, the latter portion being formed of a refractory metal. The heat capturing portion of the cathode body extends rearwardly from the electron emissive portion, i.e., in a direction opposite from the direction of intended electron emission, where it is provided with a cavity adapted for insertably receiving an electrically insulated, "slip-in" heater element. The cathode body is supported by a thin metal tubular skirt welded to the forward end of the cathode body, the skirt extending rearwardly in surrounding spaced relation to the cathode body to a point where it is joined to insulating support structure. The thickness of the heat capturing portion of the cathode body is substantially greater than the thickness of the aforementioned support skirt element whereby the heat capturing portion of the cathode body is provided with greater heat mass adjacent the electron emissive portion thereof and in surrounding relation to the electrically insulated, slip-in heater element. As a result, the heat capturing portion is able to attain a temperature close to that of the heater element, without losing much heat either by radiation or down the support skirt, and this heat is conveyed directly to the electron emissive portion. The electron emissive portion, which resides at the same temperature as the heat capturing portion, can provide substantially increased electron emission without necessitating operation of the heater at such a high temperature that burn out is likely within a short time.

In accordance with another aspect of the present invention, operation of the cathode structure is further enhanced by providing a cylindrical heat shield in surrounding relation to the aforementioned cathode body and skirt. The heat shield extends forwardly from insulating support structure of the cathode-ray-tube for surrounding the cathode and skirt in spaced relation thereto. The skirt enables further substantial reduction in the power requirements of the heater in elevating the cathode electron emissive portion to a desired temperature.

It is accordingly an object of the present invention to provide an improved cathode for cathode-ray-tubes which is capable of supplying increased beam current in a small structure.

It is another object of the present invention to provide an improved cathode structure for cathode-ray-tubes which accommodates insertable, slip-in heater elements without requiring the heater elements to operate at such a high temperature that their operating life is impaired.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION OF THE PREFERRED EMBODIMENT

Figure 1:
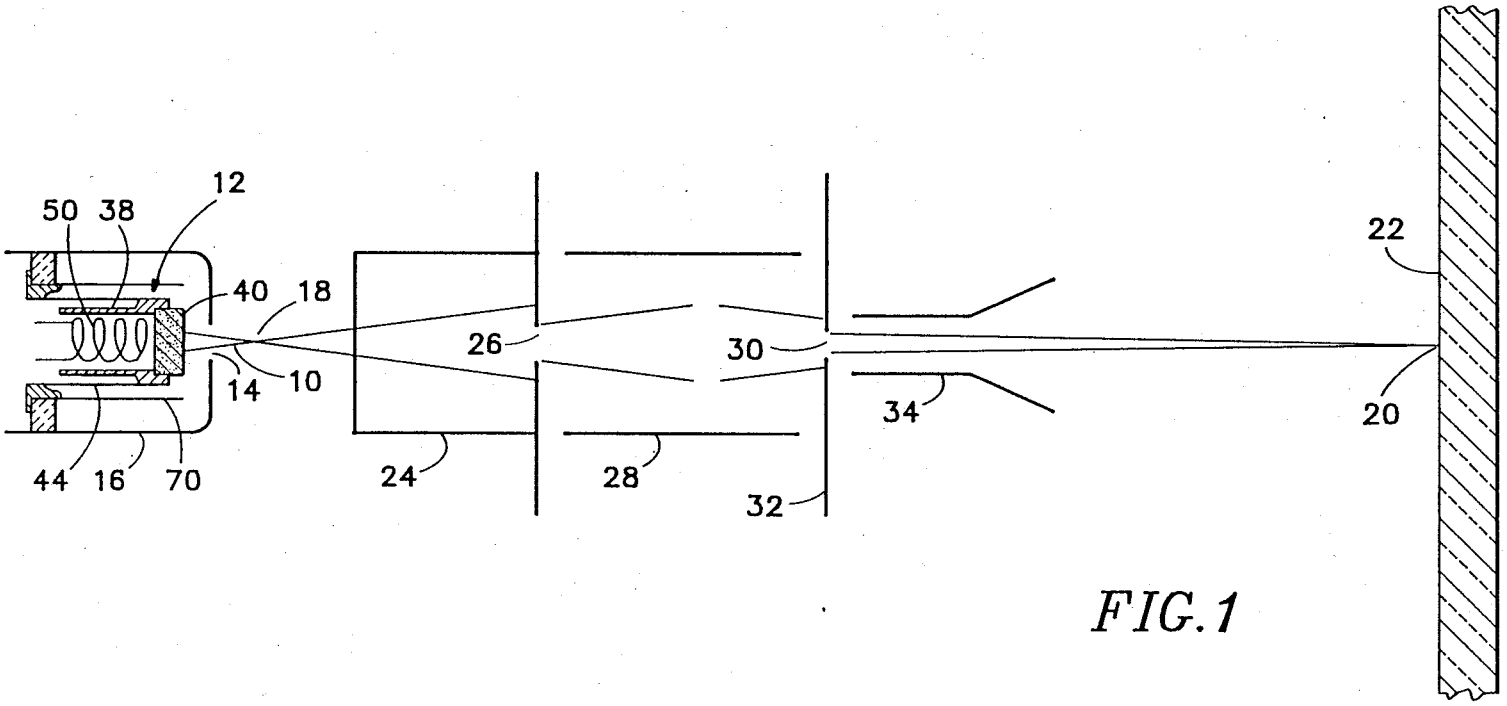
FIG. 1 is a schematic representation of an electron beam path of a cathode-ray-tube.

Referring to the drawings and particularly to FIG. 1, illustrating in cross-section the electron beam path for a cathode-ray-tube in which the present invention is employed, an electron beam 10 emitted from cathode assembly 12 through aperture 14 in grid cup 16 forms a first crossover 18 and subsequently images a spot 20 on the inner surface of face plate 22. The latter is provided with a phosphor screen layer, not shown, by means of which the spot is rendered visible. The beam leaving grid 16 is accelerated through limiting aperture 26 in first anode 24 after which it is focused by means of a plurality of focusing electrodes, schematically indicated at 28. The beam then passes through aperture 30 in second anode 32 before encountering electrostatic deflection between plates 34 whereby the spot 20 is suitably translated on the screen to form a visible trace. It will be understood that a second set of plates is conventionally provided for effecting deflection in an orthogonal direction.

In accordance with the present invention, enhanced electron emission density is produced by means of the cathode assembly 12 for achieving either a brighter spot 20, capable of depicting faster or higher bandwidth signals in the case of a measurement CRT, or a smaller spot 20, advantageously utilized for display CRTs. The cathode assembly 12 and grid 16 structure, which is somewhat exaggerated in size in FIG. 1 for illustrative purposes, is more completely represented in FIGS. 2 and 3.

Figure 2:
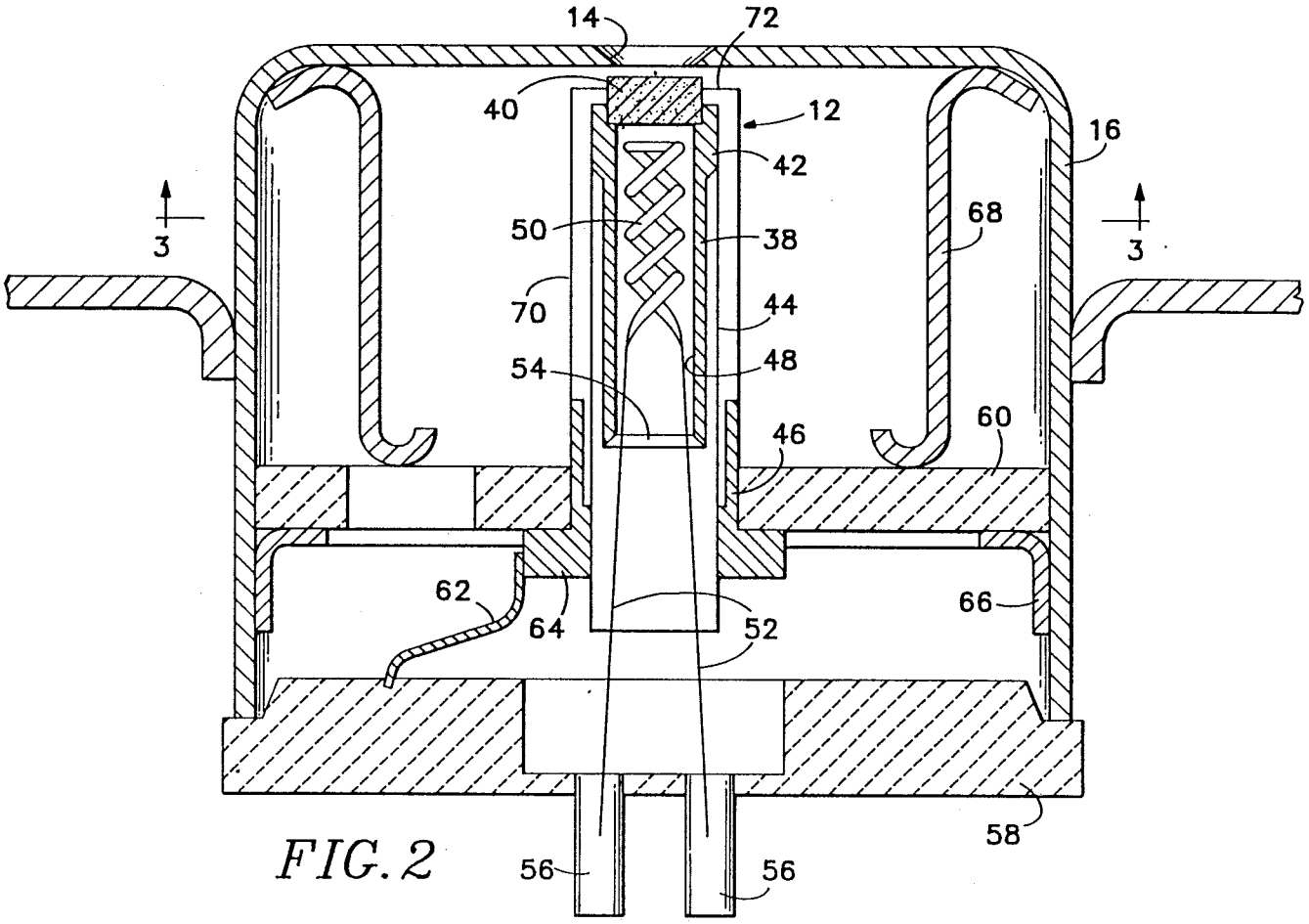
FIG. 2 is a longitudinal cross-section through a grid and cathode structure in accordance with the present invention.
Figure 3:
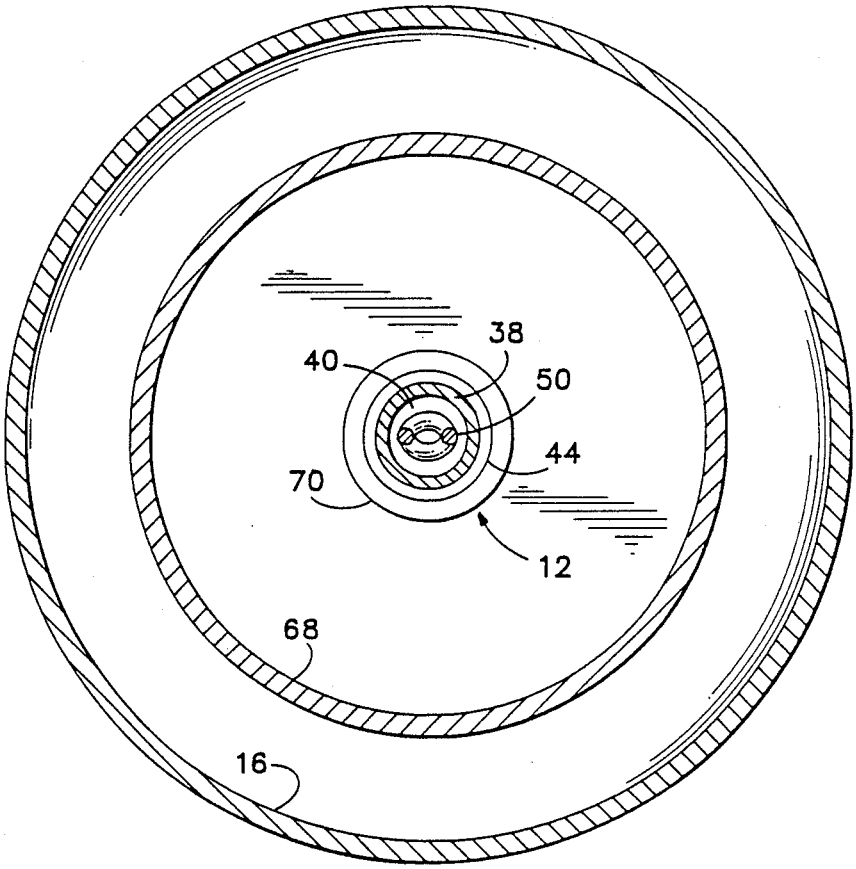
FIG. 3 is a transverse cross-section through the FIG. 2 structure as taken at 3—3 in FIG. 2.

Referring to FIGS. 1-3, the cathode structure according to the present invention includes a cathode body having a heat capturing portion 38 comprising a refractory metal cylinder which is counterbored or otherwise formed at its forward end to receive an electron emissive dispenser cathode portion 40, the latter suitably taking the form of a sintered metal pellet impregnated with a substance that emits electrons in a forward direction, i.e., through aperture 14 in grid cup 16. In a typical instance pellet 40 consists of sintered tungsten impregnated with a barium compound such as barium calcium aluminate. Cylinder portion 38, which is brazed to pellet 40, may be formed of molybdenum or other refractory metal material and in a specific embodiment had a inside diameter of 0.052 inches and a thickness, except at the forward pellet receiving end, of approximately 0.005 inches. Towards the forward end of cylinder 38, larger diameter hub portion 42 is received within and spot welded, using ruthenum as a flux, to refractory metal cylindrical sleeve or skirt 44 extending rearwardly along cylinder 38 in surrounding and spaced relation thereto past the rearward end of cylinder 38 into the aperture in annular Kovar support 46 to which it is suitably brazed. Skirt 44 is thin compared with cylinder 38, in a typical instance having a thickness of 0.7 mils, being formed of an alloy of equal parts of molybdenum and rhenium.

The inside diameter of cylinder 38 provides a cavity 48 for insertably receiving cathophoretically coated heater 50 comprising a tungsten wire having a thin layer of an insulator such as aluminum oxide deposited thereon. Conductive end leads 52 for this "slip-in" heater extend through rear aperture 54 of cylinder 38 and rearwardly through the remainder of cylindrical skirt 44 for attachment to heater terminals 56 joined to the rearward side of heater support 58. It will be seen that cylinder 38 is about two-thirds the length of thin skirt 44, the latter being brazed to the inside diameter of only the lower portion of support 46 where support 46 extends through an aperture in ceramic disk 60. The upper part of Kovar support 46 is larger in inside diameter than cylindrical skirt 44 and spaced therefrom to enhance its thermal isolation. Cathode lead 62 is secured to radial flange 64 of support 46 extending immediately behind ceramic support disk 60. Ceramic support disk 60, which separates the cathode structure from remaining cathode-ray-tube structure, is in this instance positioned inside grid cup 16 between retainer 66 on the rearward side thereof, and a Kovar spacer 68 on the forward side thereof, these elements being adapted to position the cathode in axial alignment with aperture 14 in the grid cup.

The cathode is further supplied with a thin metal heat shield 70 in the form of a refractory metal sleeve approximately 0.7 mils in thickness, suitably formed of molybdenum. Sleeve 70 is welded to the exterior of Kovar support 46 where the latter extends forwardly through the aperture in ceramic member 60. Heat shield 70 is substantially co-axial with cylinder 38 and skirt 44, having its open end 72 positioned just below the forward portion of pellet 40. It is seen that heat shield 70 together with support 46 surrounds skirt 44 in spaced relation for a distance greater than the length of cylinder 48. Moreover, cylinder 38 is spaced within skirt 44 for over eighty per cent of the length thereof, i.e., except where the two are joined at their forward ends.

Cylinder 38 has substantially greater mass and thickness than skirt 44 whereby heat radiated from heater 50 is substantially retained within cylinder 38, being captured by cylinder 38 and provided forwardly to electron emitting pellet 40. The skirt 44, which is substantially thinner, thermally isolates cylinder 38 from surrounding cathode-ray-tube structure while supporting the same, and also performs a heat shielding function. Furthermore, shield 70 provides heat shielding for retaining the heat therewithin.

The heat generated by heater 50 is thus either conveyed forwardly to emissive pellet 40 by way of cylinder 38 or is radiated directly thereupon, while a much smaller amount of heat is lost to the surrounding structure than in the case of prior art devices. Heat shielding provides for additional heat retention with consequent reduction in power requirements. The cylinder 38 portion and the pellet 40 portion of the cathode body tend to be isothermal, i.e., they reside at substantially the same temperature. Moreover, a much smaller differential is observed between the temperature of heater 50 and the temperature of pellet 40 than in constructions of the prior art. Consequently, pellet 40 can be heated to temperatures desired to provide greatly enhanced electron emission density without requiring heater 50 to attain such a high temperature that heater life is seriously impaired.

The thermal isolation of the cathode in accordance with the present invention in a typical embodiment thereof was such that it operated at 1050° CB brightness temperature with a loss of only two watts. A cathode loading of up to ten amps per square centimeter is easily possible. Moreover, economical slip-in heaters can be utilized with the structure according to the present invention since the life of the slip-in heaters is extended to greater than 27,000 hours.

The ability to load the cathode more heavily results in highly advantageous operation of a cathode-ray-tube. Since higher beam density is provided, a higher beam current can be realized, i.e., a brighter spot for writing fast images in the case of measurement CRTs, or the same beam current can be supplied in a smaller area on the screen whereby greater information density and resolution are possible in display CRTs.

A further important advantage according to the construction of the present invention relates to its mechanical stability. Prior re-entrant structures employed to secure a measure of thermal isolation were found to be substantially less stable than the instant construction, resulting in a "cut-off voltage" variation of greater than ten percent for the voltage applied to grid cup 16 (by means not shown). Mechanical expansion is controlled in the present structure and the construction is advantageously welded such that very little movement of pellet 40 takes place with respect to grid cup 16. Any expansion of heated element 38 takes place primarily in the rearward direction.

As skirt 44 expands during warmup, spacer 68 expands at the same rate, maintaining the spacing between pellet 40 and grid cup 16 substantially constant. This provides the added advantage of fast warmup times, e.g. 20 to 30 seconds to attain 90 percent of beam current.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A cathode structure for a cathode-ray-tube, said cathode structure generating a beam of electrons at a forward end thereof toward beam accelerating and focusing electrodes disposed between said forward end of said cathode structure and a beam receiving screen in said cathode-ray-tube, said cathode structure comprising:

a cathode body having an electron emissive dispenser cathode portion disposed toward the forward end of said structure comprised of a substance that emits electrons forwardly at very high temperatures for the formation of said electron beam, said cathode body having a cylindrical heat capturing portion formed of refractory metal joined in heat exchanging relation to said electron emissive portion and extending generally rearwardly therefrom, said heat capturing portion being provided with a cavity adapted for insertably receiving an electrically insulated heater element, an electrically insulated heater element inserted in said cavity, and a thin metal tubular skirt element supporting said cathode body from structure of said cathode-ray-tube, said skirt element extending rearwardly from a location of joinder with said cathode body, the mass and thickness of said heat capturing portion of said cathode body adjacent said electrically insulated heater element being substantially greater than that of said metal skirt element in supporting relation to said cathode body such that said heat capturing portion provides enhanced conduction of heat to said electron emissive portion while the thinner skirt element provides thermal isolation of said heat capturing portion from the cathode-ray-tube structure.

2. The structure according to claim 1 wherein said electron emissive dispenser cathode portion of said cathode body comprises a sintered metal material impregnated with said substance that emits electrons forwardly.

3. The structure according to claim 1 wherein said electrically insulated heater element is received substantially entirely within said cavity, said electrically insulated heater element having electrical leads extending from said cavity.

4. The structure according to claim 3 wherein said electron emissive portion is exposed to the forward end of said cavity within said heat capturing portion.

5. The structure according to claim 1 wherein said heat capturing portion of said cathode body is tubular and joined to the rear of said electron emissive portion, said cavity being tubular and substantially coaxial within said heat capturing portion, and including a heater receiving aperture at the rearward end of said heat capturing portion.

6. The structure according to claim 1 wherein said heat capturing portion is formed of molybdenum.

7. The structure according to claim 1 wherein said thin metal tubular skirt element is disposed in surrounding spaced relation to said heat capturing portion of said cathode body and is joined to the cathode body proximate the forward end thereof.

8. The structure according to claim 1 wherein the thickness of said heat capturing portion is at least about five times greater than the thickness of said skirt where said heat capturing portion is adjacent said dispenser cathode portion and surrounds said cavity.

9. The structure according to claim 1 wherein said tubular skirt element is formed of a molybdenum-rhenium alloy.

10. The structure according to claim 1 further including a tubular metal heat shield comprising a sleeve disposed in surrounding spaced relation to said cathode body and to said tubular skirt element.

11. The structure according to claim 10 wherein said heat shield is formed of molybdenum.

12. The structure according to claim 1 wherein said thin metal tubular skirt element is joined to said cathode body proximate the forward end thereof, extending rearwardly in surrounding spaced relation thereto, a grid cup receiving said cathode structure, said grid cup having a forward wall with an aperture in juxtaposition with said dispenser cathode portion and having a transversely positioned support disk to which said skirt element is joined at a location substantially rearward of said dispenser cathode portion, and spacer means disposed between said forward wall of said grid cup and said support disk which spacer means is formed of material for compensating forward expansion of said tubular skirt element toward the forward wall of said grid cup.

13. A cathode structure for a cathode-ray-tube, said cathode structure generating a beam of electrons at a forward end thereof toward beam accelerating and focusing electrodes disposed between said forward end of said cathode structure and a beam receiving screen in said cathode-ray-tube, said cathode structure comprising:

a cathode body having an electron emissive dispenser cathode portion disposed toward the forward end of said structure comprised of a substance that emits electrons forwardly at elevated temperatures for the formation of said electron beam, said cathode body having a heat capturing portion formed of refractory metal joined in heat exchanging relation to said electron emissive portion and extending generally rearwardly therefrom, said heat capturing portion being provided with a cavity adapted for insertably receiving an electrically insulated heater element, an electrically insulated heater element inserted in said cavity, a thin metal tubular skirt element supporting said cathode body from structure of said cathode-ray-tube, said skirt element extending rearwardly from a location of joinder with said cathode body and being disposed in surrounding spaced relation to said heat capturing portion, said skirt element being joined to the cathode body proximate the forward end thereof, wherein the mass and thickness of said heat capturing portion of said cathode body adjacent said electrically insulated heater element is greater than that of said metal skirt element in supporting relation to said cathode body to provide enhanced conduction of heat to said electron emissive portion as well as thermal isolation from said cathode-ray-tube structure, and wherein the forward end of said tubular skirt element is welded to the forward end of said heat capturing portion, said heat capturing portion being cylindrical and having a greater outside diameter where it is joined to said tubular skirt element than rearwardly where it is radially spaced internally within said tubular skirt element.

14. The structure according to claim 13 wherein said tubular skirt element is formed of a molybdenum-rhenium alloy.

15. A cathode structure for a cathode-ray-tube, said cathode structure generating a beam of electrons at a forward end thereof toward beam accelerating and focusing electrodes disposed between said forward end of said cathode structure and a beam receiving screen in said cathode-ray-tube, said cathode structure comprising:

a cathode body having an electron emissive dispenser cathode portion disposed toward the forward end of said structure comprised of a substance that emits electrons forwardly at elevated temperatures for the formation of said electron beam, said cathode body having a heat capturing portion formed of refractory metal joined in heat exchanging relation to said electron emissive portion and extending generally rearwardly therefrom, said heat capturing portion being provided with a cavity adapted for insertably receiving an electrically insulated heater element, an electrically insulated heater element inserted in said cavity, a thin metal tubular skirt element supporting said cathode body from structure of said cathode-ray-tube, said skirt element extending rearwardly from a location of joinder with said cathode body, wherein the mass and thickness of said heat capturing portion of said cathode body adjacent said electrically insulated heater element is greater than that of said metal skirt element in support relation to said cathode body to provide enhanced conduction of heat to said electron emissive portion as well as thermal isolation from said cathode-ray-tube structure, a tubular metal heat shield comprising a sleeve disposed in surrounding spaced relation to said cathode body and to said tubular skirt element, an insulating support member having an aperture, a cylindrical metal support received in said aperture and brazed to said insulating support member, said skirt element being brazed within said cylindrical metal support member, and said tubular metal heat shield being joined externally to said cylindrical metal support member where the latter extends forwardly through said aperture.

16. The structure according to claim 15 wherein said cylindrical metal support has an inside diameter which is smaller adjacent the rearward end of said aperture where said skirt element is joined to said cylindrical metal support, said cylindrical metal support being radially spaced from said skirt element adjacent the forward end of said aperture.

* * * * *